US005516343A

United States Patent [19]

Su

[11] Patent Number: 5,516,343

[45] Date of Patent: May 14, 1996

[54] HYDROCARBON COMPOSITIONS CONTAINING A POLYETHERAMIDE ADDITIVE

[75] Inventor: Wei-Yang Su, Austin, Tex.

[73] Assignee: Huntsman Corporation, Salt Lake City, Utah

[21] Appl. No.: 403,300

[22] Filed: Mar. 14, 1995

[51] Int. Cl.[6] ..... C10L 1/18; C10L 1/22

[52] U.S. Cl. ..... 44/419; 44/340; 44/342; 44/344; 252/51.5 A; 252/51.5 R; 252/52 A

[58] Field of Search ..... 44/340, 342, 417, 44/418, 344, 419; 252/51.5 A, 51.5 R, 52 A

[56] References Cited

U.S. PATENT DOCUMENTS

| | | | |
|---|---|---|---|
| 4,234,321 | 11/1980 | Liburn . | |
| 4,568,358 | 2/1986 | Courtney . | |
| 4,604,103 | 8/1986 | Campbell . | |
| 4,643,738 | 2/1987 | Sung et al. . | |
| 4,659,336 | 4/1987 | Sung et al. . | |
| 4,659,337 | 4/1987 | Sung . | |
| 4,747,851 | 5/1988 | Sung et al. . | |
| 4,810,261 | 3/1989 | Sung et al. . | |
| 4,881,945 | 11/1989 | Buckley, III . | |
| 5,192,335 | 3/1993 | Cherpeck | 44/387 |
| 5,211,721 | 5/1993 | Sung et al. | 44/389 |
| 5,213,585 | 5/1993 | Oppenlaender et al. | 44/433 |
| 5,250,632 | 10/1993 | Waddill et al. | 525/407 |
| 5,286,266 | 2/1994 | Herbstman | 44/417 |
| 5,288,873 | 2/1994 | Su et al. | 548/323.5 |
| 5,296,003 | 3/1994 | Cherpeck | 44/389 |
| 5,383,942 | 1/1995 | Su et al. | 44/334 |
| 5,436,351 | 7/1995 | Coffey et al . | 548/324.1 |

FOREIGN PATENT DOCUMENTS

| | | |
|---|---|---|
| 0440248 | 7/1991 | European Pat. Off. . |

*Primary Examiner*—Prince Willis, Jr.
*Assistant Examiner*—Cephia D. Toomer
*Attorney, Agent, or Firm*—Russell R. Stolle; Andy Arismendi, Jr.

[57] ABSTRACT

The instant invention relates to a hydrocarbon composition, such as motor fuel and lubricant compositions, containing a polyetheramide as a deposit control additive, to a concentrate containing such a polyetheramide as a deposit control additive, and to a method for improving the operation of an internal combustion engine.

14 Claims, No Drawings

HYDROCARBON COMPOSITIONS CONTAINING A POLYETHERAMIDE ADDITIVE

1. Field of the Invention

The instant invention relates to a hydrocarbon composition, such as motor fuel and lubricant compositions, containing a polyetheramide as a deposit control additive, to a concentrate containing such a polyetheramide as a deposit control additive, and to a method for improving the operation of an internal combustion engine.

2. Background of the Invention

Incomplete combustion of a hydrocarbonaceous motor fuel in an internal combustion engine is a common problem which generally results in the formation and accumulation of carbon deposits on various parts of the combustion chamber as well as on the fuel intake and exhaust systems of the engine. The presence of carbon deposits in the combustion chamber seriously reduces the operating efficiency of the engine. First, deposit accumulation within the combustion chamber inhibits heat transfer between the chamber and the engine cooling system. This leads to higher temperatures within the combustion chamber, resulting in increases in the end gas temperature of the incoming charge. Consequently, end gas auto-ignition occurs, which causes engine knock. In addition, the accumulation of carbon deposits within the combustion chamber reduces the volume of the combustion zone, causing a higher than design compression ratio in the engine. This, in turn, also results in serious engine knocking. A knocking engine does not effectively utilize the energy of combustion. Moreover, a prolonged period of engine knocking will cause stress fatigue and wear in vital parts of the engine.

The above-described phenomenon is characteristic of gasoline powered internal combustion engines. It is usually overcome by employing a higher octane gasoline for powering the engine, and hence has become known as the engine octane requirement increase (ORI) phenomenon. It would be highly advantageous if engine ORI could be substantially reduced or eliminated by preventing carbon deposits in the combustion chamber of the engine.

Another problem common to internal combustion engines is the formation of intake valve deposits. Intake valve deposits interfere with valve closing and eventually will lead to valve burning. Such deposits interfere with valve motion and valve seating and tend to reduce the volumetric efficiency of the engine and to limit the maximum design power. Valve deposits may be produced from thermally and oxidatively unstable fuel or from lubricating oil oxidation products. The hard carbonaceous deposits produced collect in the tubes and runners that are part of the exhaust gas recirculation (EGR) flow. These deposits are believed to be formed from exhaust particles which are subjected to rapid cooling while mixing with the air-fuel mixture. Reduced EGR flow can result in engine knock and in nitric oxide, $NO_x$, emission increases. It would therefore be desirable to provide a motor fuel composition which minimizes or overcomes the formation of intake valve deposits.

A further problem relates to the accumulation of deposits in the carburetors and inlet systems of gasoline engines as well as the fuel injection systems of gasoline and diesel engines. These deposits result from exposure to contamination due to dust particles from the air, unburned hydrocarbon residues from the combustion chamber, and the crankshaft housing vent gases which are passed into the carburetor. The deposits tend to restrict the flow of air through the carburetor altering the air-fuel ratio at idle and at low speeds, resulting in an overrich fuel mixture. This condition also promotes incomplete fuel combustion, leads to rough engine idling and engine stalling, and increased fuel consumption. Excessive hydrocarbon and carbon monoxide exhaust emissions are also produced under these conditions.

Diesel fuels are susceptible to impurities which may arise from a variety of sources. They may occur in the fuel as produced or refined, or may through oxidation resulting from aging, produce soluble and insoluble materials of higher molecular weight and boiling point than the original fuel, which manifest themselves in the engines as colors or gums. Impurities may also be introduced in handling or from corrosion of storage vessels, either in the vehicle or in inventory. There may even be other additives specifically introduced by the manufacturer to solve or prevent some particular problem or improve the fuel itself, for example anti-oxidants, rust preventatives, and the like.

All of these impurities, however, may give rise to deposit formation in the fuel system of compression ignition engines, in particular, at the critical junctions of the fuel injectors. These deposits coat or adhere to injector parts and cause injector sticking, injector tip fuel metering passage fouling, nozzle hole plugging, leakage past critical surfaces, and delayed injection (and, hence, delayed start of combustion). These problems, in turn, result in significantly increased engine noise, smoke emissions, misfiring, low temperature or cold start problems, and idle roughness; and decreased power output and fuel economy.

It is, therefore, highly desirable to provide fuel compositions which contain deposit control additives which effectively control deposits in intake systems (carburetor, valves, etc.) of engines operated with fuels containing them, but do not contribute to the combustion chamber deposits which cause increased octane requirements. While, in general, deposit control fuel additives are not believed to be useful dispersants for lubricating oil compositions, the additives of the present invention are useful in this regard.

SUMMARY OF THE INVENTION

The novel hydrocarbon composition of the invention comprises a major portion of a hydrocarbon distillate and a minor portion of a polyetheramide, as a deposit control additive, of the following formula.

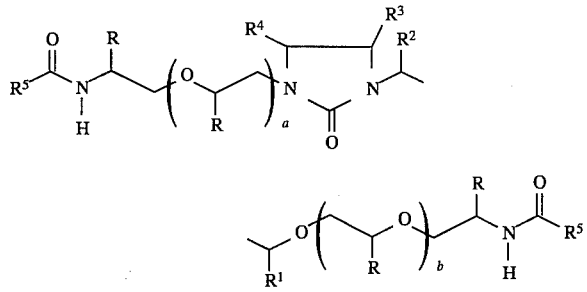

wherein each R is independently H or an alkyl group containing from 1 to about 16 carbon atoms, preferably each R group is independently H or an alkyl group containing from 1 to about 4 carbon atoms, and more preferably each R group is independently a methyl or ethyl group, wherein each of $R^1$, $R^2$, $R^3$ and $R^4$ is independently selected from the group consisting of H and lower alkyl groups containing from 1 to about 4 carbon atoms, and wherein each $R^5$ is independently a saturated or unsaturated alkyl group containing from about 7 to about 22 carbon atoms, and a+b+2=n, wherein n is the number of moles of alkylene oxide used in the alkoxylation step. Preferably, a+b ranges from 0 to about 80, more preferably from about 5 to about 50, and yet more preferably from about 10 to about 30. The hydrocarbon distillate may be a fuel, such as a gasoline or diesel fuel, and an oil having a lubricating viscosity. For convenience of shipping and handling, a concentrate of the polyetheramide and an inert stable oleophilic organic solvent is also provided.

There also is provided a method for improving the operation of an internal combustion engine equipped with fuel metering apparatus for and designed to operate with a hydrocarbon distillate fuel. This method comprises:

operating the engine using an additized fuel prepared by introducing an effective amount of an additive into the hydrocarbon distillate fuel under conditions sufficient to clean performance-inhibiting deposits from the apparatus or combustion chamber elements. The additive comprises a polyetheramide of the formula:

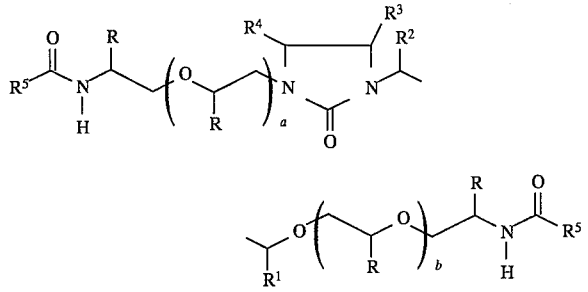

wherein each R is independently H or an alkyl group containing from 1 to about 16 carbon atoms, preferably each R group is independently H or an alkyl group containing from 1 to about 4 carbon atoms, and more preferably each R group is independently a methyl or ethyl group, and wherein each of $R^1$, $R^2$, $R^3$ and $R^4$ is independently selected from the group consisting of H and lower alkyl groups containing from about 1 to about 4 carbon atoms, and wherein each $R^5$ is independently a saturated or unsaturated alkyl group containing from about 7 to about 22 carbon atoms, and wherein a+b ranges from 0 to about 80.

DESCRIPTION OF THE INVENTION

The process for preparing such polyetheramide compounds comprises:

1. Preparation of hydroxyalkyl-2-imidazolidones (III) from urea (II) and the corresponding aminoalkylalkanolamine (I) represented by:

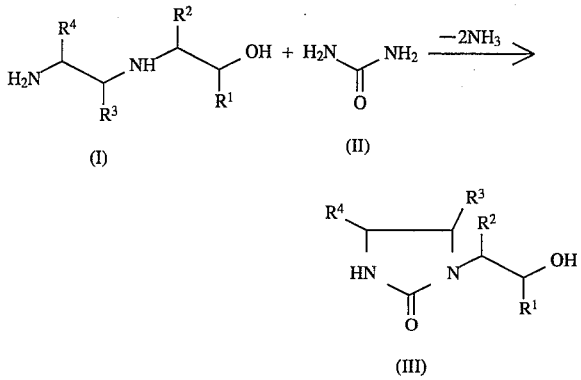

It may be noted that other possible feedstock which can be used instead of urea include dimethyl carbonate and ethylene carbonate.

2. Alkoxylation of a 1-2'-hydroxyalkyl-2-imidazolidone with an alkylene oxide to produce a polyol (IV), as represented by:

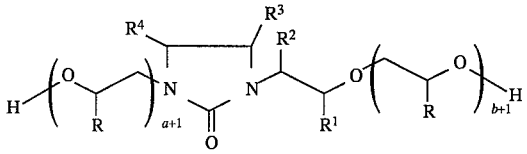

(IV)

3. Reductive amination of the polyol (IV) to form a novel polyetherdiamine (V) containing an imidazolidone and, therefore, a cyclic urea, as represented by:

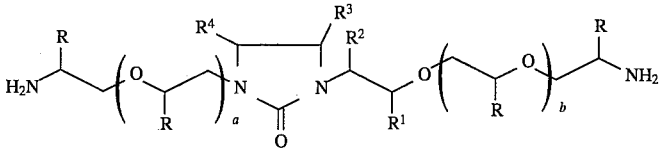

(V)

wherein each of $R^1$, $R^2$, $R^3$ and $R^4$ is independently selected from the group consisting of H and lower alkyl groups containing from 1 to about 4 carbon atoms, wherein each R is independently H or an alkyl group containing from 1 to about 16 carbon atoms, preferably each R group is independently H or an alkyl group containing from 1 to about 4 carbon atoms, and more preferably each R group is independently a methyl or ethyl group, and wherein a+b ranges from 0 to about 80. This step generally takes place at temperatures from 180° C. to 240° C. Steps 1–3 above are described in U.S. Pat. No. 5,288,873, incorporated herein by reference in its entirety.

4. The polyetherdiamine (V) is reacted with a fatty alkyl acid of the formula:

$R^5COOH$ (VI)

wherein $R^5$ is a saturated or unsaturated alkyl group containing from about 7 to about 22 carbon atoms, resulting in a polyetheramide (VII) of the formula:

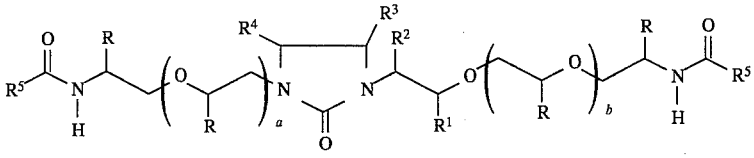

(VII)

wherein each R is independently H or an alkyl group having from 1 to about 16 carbon atoms, preferably each R group is independently H or an alkyl group containing from 1 to about 4 carbon atoms, and more preferably each R group is independently a methyl or ethyl group, and wherein each of $R^1$, $R^2$, $R^3$ and $R^4$ is independently selected from the group consisting of H and lower alkyl groups having from 1 to about 4 carbon atoms and each $R^5$ is independently a saturated or unsaturated alkyl group containing from about 7 to about 22 carbon atoms.

Such polyetheramides are useful in the present invention as a deposit control additive hydrocarbon distillates, for example, in motor fuels and lubricants.

The sequence for preparing the imidazolidone containing polyetherdiamides (VII), starting with the substituted imidazolidone (III), can be represented best by the following:

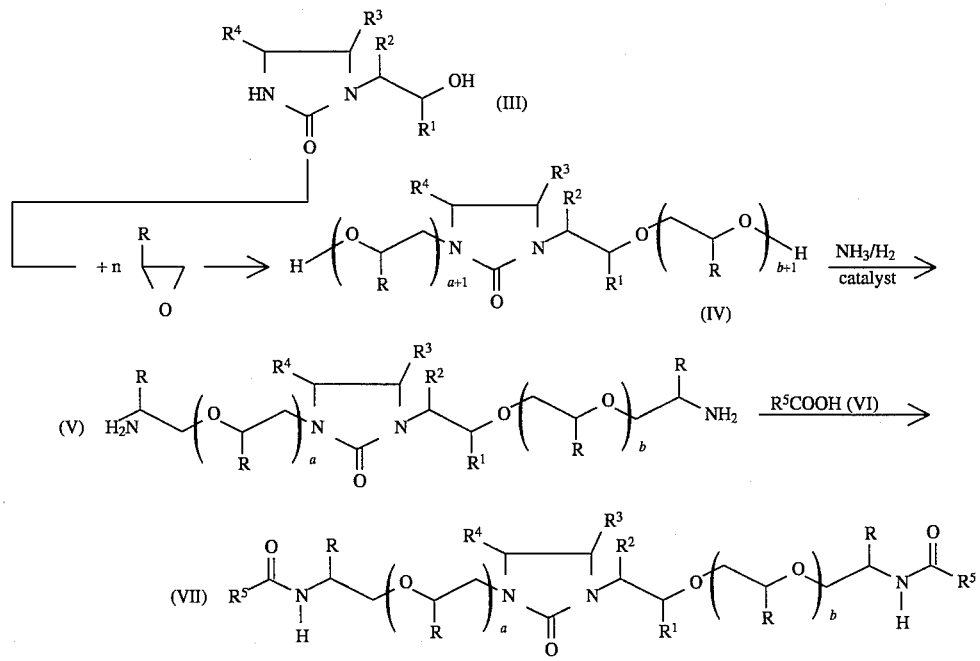

wherein each R is independently H or an alkyl group containing from 1 to about 16 carbon atoms, preferably each R group is independently H or an alkyl group containing from 1 to about 4 carbon atoms, and more preferably each R group is independently a methyl or ethyl group, and wherein each of $R^1$, $R^2$, $R^3$ and $R^4$ is independently selected from the group consisting of H and lower alkyl groups having from 1 to about 4 carbon atoms, and wherein a+b ranges from 0 to about 80. The number of moles of alkylene oxide employed in the alkoxylation step is n=a+b+2. In regard to a reaction product, the values of a, b and n may not be a whole number as they represent molar average of the reaction product.

The initiator, 1-hydroxyalkyl-2-imidazolidone, can be easily prepared by reacting urea, dimethyl carbonate, ethylene carbonate or propylene carbonate with the corresponding aminoalkylalkanolamine and is represented by the structure:

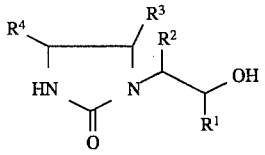

(III)

wherein each of $R^1$, $R^2$, $R^3$ and $R^4$ is independently selected from the group of H and lower alkyl groups having from 1 to about 4 carbon atoms. Examples of 1-2'-hydroxyalkyl-2-imidazolidones that are suitable initiators in the desired synthesis of polyols include 1-2'-hydroxyethyl-2-imidazolidone (HEIMD),
1-2'-hydroxypropyl-2-imidazolidone,
1-2'-hydroxyethyl-4-methyl-2-imidazolidone,
1-2'-hydroxyethyl-5-methyl-2-imidazolidone,
1-2'-hydroxyethyl-4,5-dimethyl-2-imidazolidone,
1-2'-hydroxypropyl-4,5-dimethyl-2-imidazolidone and
1-2'-hydroxy-1'-methylpropyl-2-imidazolidone.

The alkoxylation reaction employed to prepare the propylene oxide adduct of the cyclic urea initiator utilized to prepare the polyetheramide compounds useful in this invention is carried out according to methods well-known in the art, as described in U.S. Pat. No. 5,288,873 (see Examples 2–3 and Table I therein).

The alkoxylation proceeds using alkylene oxides containing 2 to about 16 carbon atoms, or combinations thereof. Particularly suitable are ethylene oxide, propylene oxide and butylene oxide or combinations thereof. Variations in the number of moles of alkylene oxides or mixtures thereof used in alkoxylation result in predictably different hydroxyl number products, expressed as mg KOH/g, for the resulting polyols.

The alkoxylated substituted HEIMD products can be converted to the corresponding primary amines by reaction with ammonia over a hydrogenation/dehydrogenation catalyst. Generally reductive amination catalysts are composed primarily of nickel, cobalt or copper, or these metals in combination as the active components. The catalyst can contain other metals as well, such as iron, zinc, chromium, manganese, zirconium, molybdenum tungsten, rhenium, and ruthenium. Other promoters such as barium, magnesium, and phosphorous have been used in reductive amination catalysts. Precious metals such as platinum and palladium have also been used in some catalysts. The catalysts can be unsupported or supported. Common supports that have been used for these catalysts include alumina, silica, silica-alumina, zirconia, magnesia, and titania. This is discussed in U.S. Pat. No. 5,288,873.

Examples of reductive amination catalysts described in U.S. Pat. No. 5,288,873 comprised (1) nickel and copper on alumina and (2) nickel, copper, chromium and molybdenum supported on alumina. The quantity of nickel compound and copper, along with chromium and molybdenum which are employed in the catalyst may vary. According to U.S. Pat. No. 5,288,873, good results are observed where the catalyst consisted essentially of 10–40 wt. % nickel, 2–25 wt. % copper and 0.1 to 2 wt. % each of chromium and molybdenum as well as at least 50 wt. % of the refractory metal oxide support. A preferred catalyst composition described therein comprises 15 to 30 wt. % nickel, 3–20 wt. % copper and 0.5 to 10 wt. % each of chromium and molybdenum.

No significant amount of product degradation occurred during the amination reactions. A number of other catalysts known in the art to be active in reductive amination, such as, for example, Raney nickel would be expected to be active and selective and, therefore, useful in this reaction.

The temperature for the amination of the polyol should be in the range of 150° C.–350° C. and is preferably from 180° C. to 240° C.

The pressure for amination should be in the range from 500 to 4000 psig and preferably from 1500 to 2500 psig.

The polyetherdiamine is reacted with a carboxylic acid of the formula $R^5COOH$, which may be fatty acids derived from or contained in an animal or vegetable fat or oil. $R^5$ represents an alkyl group containing from about 7 to about 22 carbon atoms. The fatty acid may be saturated or unsaturated. Examples of saturated fats include, but are not limited to, lauric ($C_{12}$), palmitic ($C_{16}$) and stearic ($C_{18}$). No catalyst is required for this reaction. The fatty acids may also be unsaturated. These acids are usually vegetable derived and have alkyl groups containing at least 18 carbon atoms. Most vegetable oils are actually mixtures of several fatty acids or their glycerides. The most common unsaturated acids are oleic, linoleic and linolenic acids (all $C_{18}$). Another suitable fatty acid, more properly a mixture of fatty acids, is that derived from coconut oil, containing from about 6 to about 18 carbon atoms, comprised of glycerides mostly of lauric ($C_{12}$), capric ($C_{10}$), myristic ($C_{14}$), palmitic ($C_{16}$) and oleic ($C_{18}$) acids. Another fatty acid is oleic, $CH_3(CH_2)_7CH{:}CH(CH_2)_7COOH$, a monounsaturated fatty acid component of almost all natural fats as well as tall oil.

The temperature for this reaction should be in the range of 90° C. to 200° C. and is preferably from 125° to 180° C.

The pressure should be in the range from 0 to 500 psig and preferably from 0 to 100 psig.

The focus of the instant invention is the use of such polyetheramides as a motor fuel additive and lubricant additive to provide or enhance the detergency and deposit control properties of fuels and lubricants in internal combustion engines. The polyetheramides useful in the instant invention contain an ethylene urea (2-imidazolidone) linkage. It is expected to be stable in combustion engine environments.

The polyetheramides useful in the present invention have been described with a view to providing the most effective lubricating oil and fuel additives, not only for lower ORI, but to provide other properties and to confront other problems as well. While ORI is the major problem confronted by the additives of this invention, other desirable properties or undesirable problems of fuel and lubricating oil compositions include deposit control, sludge formation, detergency, viscosity, dispersancy, cetane, water tolerance, rust, oxidation, compatibility and interaction with motor oil additives as well as fuel components and fuel additives.

Fuel Compositions

The polyetheramides useful in this invention will generally be employed in a hydrocarbon distillate fuel. The hydrocarbon distillate fuel may be a mixture of hydrocarbons in the gasoline or diesel boiling range. Preferred motor fuel compositions for use with the polyetheramide additive in the instant invention are those intended for use in spark ignition internal combustion engines. Such motor fuel compositions, generally referred to as gasoline base stocks, preferably comprise a mixture of hydrocarbons boiling in the gasoline boiling range, preferably from about 90° F. to about 450° F. This base fuel may consist of straight chains or branched chains or paraffins, cycloparaffins, olefins, aromatic hydrocarbons, or mixtures thereof. The base fuel can be derived from, among others, straight run naptha, polymer gasoline, natural gasoline, or from catalytically cracked or thermally cracked hydrocarbons and catalytically reformed stock. The composition and octane level of the base fuel are not critical and any conventional motor fuel base can be employed in the practice of this invention.

Suitable motor gasolines are leaded and unleaded regular and premium grades. The gasolines may also contain other components as hydrocarbons, e.g., alcohols such as methanol, ethanol and tert-butanol or ethers, e.g., methyl tert-butyl ether. Diesel fuels, heavy oils such as SNO-600, SNO-850, etc., and synthetics such as propylene glycol (m.w. 1000) also may be used. In addition to the polyetheramides to be used according to the present invention, the hydrocarbon distillate fuels generally contain further additives such as corrosion inhibitors, stabilizers, antioxidants and/or further detergents.

The proper concentration of polyetheramide additive necessary in order to achieve the desired deposit control effect depends upon the type of fuel employed, the presence of other detergents, dispersants and other additives, etc. Generally, the range of concentration of the additive in the fuel is from about 30 to about 2000 weight parts per million (ppm; e.g., 1 mg of polyetheramide per kg of fuel would be equivalent to 1 ppm), preferably from about 100 to about 500 ppm of the polyetheramide per part of hydrocarbon distillate fuel, whether gasoline or diesel. When other detergents are present, a lesser amount of the polyetheramide may be used.

The polyetheramide used as a deposit control additive may be formulated as a concentrate for convenience in shipping and handling, using an inert stable oleophilic organic solvent boiling in the range of about 150° to 400° F. Preferably, an aliphatic or an aromatic hydrocarbon solvent is used, such as benzene, toluene, xylene or higher-boiling aromatics or aromatic thinners. Aliphatic alcohols of about 3 to about 8 carbon atoms, such as isopropanol, isobutylcarbinol, n-butanol and the like, in combination with hydrocarbon solvents are also suitable for use with the detergent-dispersant additive. In the concentrate, the amount of the additive will be ordinarily at least 10 percent by weight and generally not exceed 80 percent by weight and preferably from 25 to 60 weight percent.

Corrosion inhibitors are usually ammonium salts of organic carboxylic acids which by virtue of the structure of the starting compounds tend to be film-forming. Amines for reducing the pH are frequently also used as corrosion inhibitors. The corrosion inhibitors for non-ferrous metals are usually heterocyclic aromatics.

Suitable antioxidants or stabilizers are in particular amines such as paraphenylenediamine, dicylohexylamine, morpholine or derivatives of these amines. Other motor fuel and lubricant additives are phenolic antioxidants such as 2,4-di-tert-butylphenol or 3,4,5-di-tert-butyl-4-hydroxyphenylpropionic acid and derivatives thereof.

Motor fuels may further contain, as further carburetor, injector and valve detergents, amides and imides of polyisobutylenesuccinic anhydride, polybutenepolyamines and long-chain carboxamides and -imides.

In gasoline fuels, other fuel additives may also be included such as antiknock agents, e.g., methylcyclopentadienyl manganese tricarbonyl, tetramethyl or tetraethyl lead, or other dispersants or detergents such as various substituted succinimides, amines, etc. Also included may be lead scavengers such as alkyl halides, e.g., ethylene dibromide. Additionally, antioxidants, metal deactivators and demulsifiers may be present.

In diesel fuels, other well-known additives can be employed, such as pour point depressants, flow improvers, cetane improvers, and the like.

A particularly useful additive is a fuel-soluble carrier oil. Exemplary carrier oils include nonvolatile poly(oxyalkylene) alcohols, diols and polyols; other synthetic lubricants or lubricating mineral oil. Particularly preferred carrier oils are poly(oxyalkylene) mono and polyols, such as the Pluronics marketed by BASF Wyandotte Corp., and the UCON LB-series fluids marketed by Union Carbide Corp. Other carrier oils are disclosed in U.S. Pat. No. 5,296,003, incorporated herein by reference. When used, these oils are believed to act as a carrier for the detergent and assist in removing and retarding deposits. They are employed in amounts from about 0.005 to 0.5 percent by volume, based on the final gasoline composition. Preferably, 100–5,000 ppm by weight of a fuel-soluble poly(oxyalkylene) alcohol, glycol or polyol is used as a carrier oil. In the previously described concentrate, the carrier oil is usually present in amounts of from 5 to 80 percent by weight.

Lubricating Oil Compositions

The lubricating oil compositions of the invention are useful for lubricating internal combustion engines. The lubricating oils not only lubricate the engine, but, because of their dispersancy properties, help maintain a high degree of cleanliness of the lubricated parts.

Suitable lubricating oils which can be used to prepare a lubricating oil composition or concentrate of this invention are oils of lubricating viscosity derived from petroleum or synthetic sources. The oils can be paraffinic, naphthenic, flouro-substituted hydrocarbons, synthetic esters, polyethers, alkylbenzenes, or combinations thereof. Oils of lubricating viscosity have viscosities in the range of about 35 to about 50,000 Saybolt Universal Seconds (SUS) at 100° F., and more usually from about 50 to about 10,000 SUS at 100° F. The amount of the polyetheramide useful in this invention which is incorporated into the lubricating oil to provide the effective amount necessary for dispersancy varies widely with the particular product used as well as the use intended for the lubricating oil composition. Other conventional additives which can be used in combination with the product of this invention include ashless dispersants such as the type disclosed in U.S. Pat. Nos. 3,172,892, 3,219,666, and 3,381,022; neutral and basic calcium, barium and magnesium petrosulfonates or alkyl phenates; oxidation inhibitors, antifoam agents, viscosity index improvers, pour-point depressants, and the like, such as chlorinated wax, benzyldisulfide, sulfurized sperm oil, sulfurized terpene; phosphorus esters such as trihydrocarbon phosphites and phosphates; metal thiocarbamates such as zinc dioctyldithiocarbamate; metal phosphorus dithioates such as zinc dioctylphosphorodithioate; polyisobutene having an average molecular weight of 100,000; etc.

In general, the lubricating oil compositions will contain from about 0.01 to 20 weight percent of the polyetheramide. More usually, the lubricating oil composition of the invention will contain from about 0.5 to about 10 weight percent of the polyetheramide and more usually from about 1 to about 8 weight percent of the polyetheramide.

In a second embodiment of this invention, lubricating oil additive concentrates are provided comprising from about 90 to about 20 percent of an inert stable oleophilic solvent such as oil of lubricating viscosity and from about 10 to about 80 weight percent of the polyetheramide. Typically, the concentrates contain sufficient diluent to make them easy to handle during shipping and storage. Preferably, the diluent is an oil of lubricating viscosity so that the concentrate may be readily mixed with lubricating oils to prepare lubricating oil compositions. Suitable lubricating oils which can be used as diluents typically have viscosities in the range from about 35 to about 1000 SUS at 100° F., although any oil of lubricating viscosity can be used.

In the following examples, polyetheramides are prepared which are suitable for use as a deposit control additive in distillate hydrocarbons, for example, in gasoline or diesel fuels and in oils of lubricating viscosity. All parts, percentages or other amounts given throughout this disclosure are by weight unless otherwise indicated.

EXAMPLES

Example 1 (7237-6)

Preparation of Polyetheramide

A three-liter three-necked flask equipped with a thermometer, Dean-Stark trap, stirrer, and nitrogen inlet was charged with about 1000 g of an aminated 11-mole propylene oxide adduct of 1-2'-hydroxyethyl-2-imidazolidone and about 570 g of coconut acid. The mixture was heated to about 170° C. for about seven hours. About 44 g of water was generated and removed through the Dean-Stark trap. The resulting polyetheramide was a brown liquid and was hydrocarbon soluble.

Example 2 (7237-67)

Preparation of Polyetheramide

The procedure of Example 1 was followed except that about 765 g of oleic acid instead of coconut acid was used. About 44 g of water was generated and removed through the Dean-Stark trap. The resulting product was a brown liquid and was hydrocarbon soluble.

What is claimed is:

1. A hydrocarbon composition comprising a major portion of a hydrocarbon distillate and a minor portion sufficient to effect deposit control of a polyetheramide, as a deposit control additive, having the formula

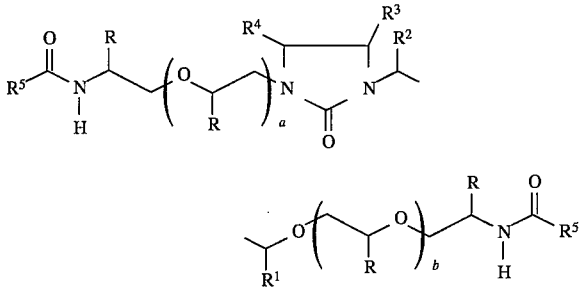

wherein each R is independently H or an alkyl group containing from 1 to about 16 carbon atoms, wherein each of $R^1$, $R^2$, $R^3$ and $R^4$ is independently selected from the group consisting of H and lower alkyl groups containing from about 1 to about 4 carbon atoms, and wherein each $R^5$ is independently a saturated or unsaturated hydrocarbon group containing from about 7 to about 22 carbon atoms, and wherein a+b ranges from 0 to about 80.

2. The hydrocarbon composition according to claim 1, wherein the hydrocarbon distillate is a fuel.

3. The hydrocarbon composition according to claim 2, wherein the fuel is a mixture of hydrocarbons in the gasoline boiling range.

4. The hydrocarbon composition according to claim 3, wherein the polyetheramide is present in an amount ranging from about 30 to about 2000 ppm.

5. The hydrocarbon composition according to claim 2, wherein the fuel is a mixture of hydrocarbons in the diesel boiling range.

6. The hydrocarbon composition according to claim 5, wherein the polyetheramide is present in an amount ranging from about 30 to about 2000 ppm.

7. The hydrocarbon composition according to claim 1, wherein the hydrocarbon distillate is an oil of lubricating viscosity.

8. The hydrocarbon composition according to claim 7, wherein the polyetheramide is present in an amount from about 0.01 to about 20 percent by weight of the polyetheramide based on the weight of the oil.

9. The hydrocarbon composition according to claim 1, wherein each R is independently H or an alkyl group containing from 1 to about 4 carbon atoms.

10. The hydrocarbon composition according to claim 9, wherein each R is independently a methyl or ethyl group.

11. The hydrocarbon composition according to claim 1, wherein a+b ranges from about 5 to about 50.

12. The hydrocarbon composition according to claim 11, wherein a+b ranges from about 10 to about 30.

13. A method for improving the operation of an internal combustion engine equipped with fuel metering apparatus for and designed to operate with a hydrocarbon distillate fuel, said method comprising:

operating said engine using an additized fuel prepared by introducing an effective amount of an additive into said hydrocarbon distillate fuel under conditions sufficient to clean performance-inhibiting deposits from said apparatus or combustion chamber elements, said additive comprising a polyetheramide of the formula:

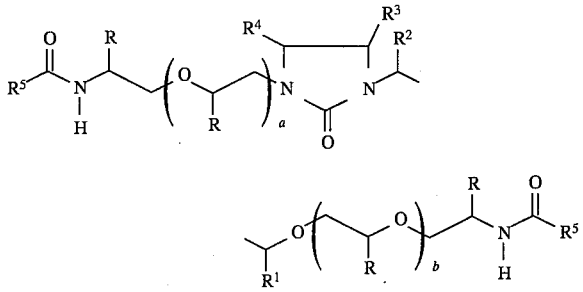

wherein each R is independently H or an alkyl group containing from 1 to about 16 carbon atoms, wherein each of $R^1$, $R^2$, $R^3$ and $R^4$ is independently selected from the group consisting of H and lower hydrocarbon groups containing from about 1 to about 4 carbon atoms, and wherein each $R^5$ is independently a saturated or unsaturated alkyl group containing from about 7 to about 22 carbon atoms, and wherein a+b ranges from 0 to about 80.

14. A concentrate composition comprising:

an inert stable oleophilic organic solvent and from about 10 to about 80 percent by weight of a polyetheramide based on the weight of the solvent, wherein the polyetheramide is of the formula:

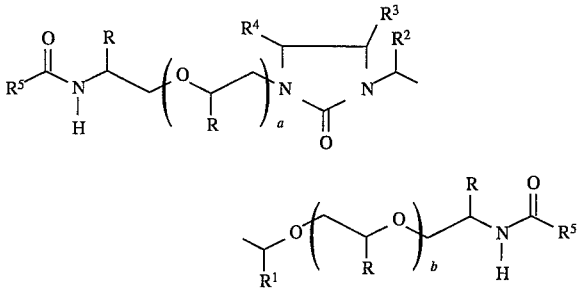

wherein each R is independently H or an alkyl group containing from 1 to about 16 carbon atoms, wherein each of $R^1$, $R^2$, $R^3$ and $R^4$ is independently selected from the group consisting of H and lower alkyl groups containing from about 1 to about 4 carbon atoms, and wherein each $R^5$ is independently a saturated or unsaturated hydrocarbon group containing from about 7 to about 22 carbon atoms, and wherein a+b ranges from 0 to about 80.

* * * * *